US005097628A

United States Patent [19]

Kobayashi

[11] Patent Number: 5,097,628

[45] Date of Patent: Mar. 24, 1992

[54] VALVE OPERATING STRUCTURE

[75] Inventor: Masahiko Kobayashi, Osaka, Japan

[73] Assignee: Kubota, Ltd., Osaka, Japan

[21] Appl. No.: 414,096

[22] Filed: Sep. 28, 1989

[30] Foreign Application Priority Data

Nov. 1, 1988 [JP] Japan ..... 63-143898[U]

[51] Int. Cl.[5] ..... G05G 9/00

[52] U.S. Cl. ..... 74/471 R; 74/471 XY

[58] Field of Search ..... 74/501.5 R, 471 R, 471 XY, 74/475, 480 R, 473

[56] References Cited

U.S. PATENT DOCUMENTS

| | | | |
|---|---|---|---|
| 2,193,218 | 3/1940 | Best | 74/673 |
| 4,524,635 | 6/1985 | Hulin et al. | 74/475 |
| 4,553,446 | 11/1985 | Matsubara | 74/471 R |
| 4,612,829 | 9/1986 | Fukaya et al. | 74/480 R |
| 4,619,152 | 10/1986 | Suzuki | 74/501.5 R |
| 4,646,778 | 3/1987 | Tsuji et al. | 74/471 R |
| 4,736,647 | 4/1988 | Shimoie et al. | 74/471 R |

FOREIGN PATENT DOCUMENTS

| | | |
|---|---|---|
| 2141198 | 12/1984 | United Kingdom . |
| 2183795 | 6/1987 | United Kingdom . |

*Primary Examiner*—Leslie A. Braun
*Assistant Examiner*—Winnie Yip
*Attorney, Agent, or Firm*—Gifford, Groh, Sprinkle, Patmore and Anderson

[57] ABSTRACT

A valve operating structure for a working vehicle having different control valves with slide spools extending parallel to each other. A control lever is operatively connected to an interlocking member for selectively operating the control valves. The valve operating structure comprises an interlock switching mechanism for moving the interlocking member between a position to engage one slide spool and a position to engage another slide spool. The interlocking member is pivotable about a point located at substantially the same distance to the two spools, with a free end thereof extending to a position between the spools. The two interlocking positions are selectively provided by connecting the free end to one of the spools.

8 Claims, 5 Drawing Sheets

VALVE OPERATING STRUCTURE

BACKGROUND OF THE INVENTION (1) Field of the Invention

The present invention relates to a valve operating structure switchable between a position for allowing a single operating device to operate one control valve, and a position for allowing the operating device to operate another control valve. More particularly, the invention relates to a valve operating structure comprising a first and a second control valves having a first and a second slide spools, respectively, which extend parallel to each other, a control lever operatively connected to a lever interlocking member for selectively operating the first and second valve, and an interlock switching mechanism for moving the lever interlocking member between a first interlocking position to engage the first slide spool, and a second interlocking position to engage the second slide spool.

(2) Description of the Prior Art

A valve operating structure as noted above is disclosed in U.S. Pat. No. 4,553,446, for example. This known structure comprises a seesaw type link pivotally supported at a position displaced from the pivotal axis of a pivotable link operatively connected to an operating device. Opposite ends of the seesaw link are operatively connected to a first slide spool of a first control valve and a second slide spool of a second control valve, respectively. A fixing element is provided for selectively engaging an interlocking member between the seesaw link and the first slide spool, and an interlocking member between the seesaw link and the second slide spool to hold the interlocking member against sliding movement. When the operating device is operated with the fixing element acting on the second spool, the seesaw link pivots about an axis of connection of the interlocking member connected to the second spool, whereby the first spool slides to switch the first control valve. When the operating device is operated with the fixing element acting on the first spool, the seesaw link pivots about an axis of connection of the interlocking member connected to the first spool, whereby the second spool slides to switch the second control valve.

In the above operating structure, the interlock switching mechanism has a complicated construction. Because of play provided for the pivotal attachments and connections of the links and interlocking members, the operating device must be operated through a long stroke for switching the control valves, compared with the stroke of the slide spools. Further, the known structure has the disadvantage of relatively low operating efficiency with the intended slide spool remaining still and only the operating device operated without effect.

SUMMARY OF THE INVENTION

An object of the present invention, therefore, is to provide a valve operating structure having a simple construction and excellent response to an operation.

The above object is achieved, according to the present invention, by a valve operating structure comprising a first and a second control valves having a first and a second slide spools, respectively, which extend parallel to each other, a control lever operatively connected to a lever interlocking member for selectively operating the first and second valve, and an interlock switching mechanism for moving the lever interlocking member between a first interlocking position to engage the first slide spool, and a second interlocking position to engage the second slide spool, wherein the lever interlocking member is pivotable about a pivotal point located at substantially the same distance to the first and second slide spools, the lever interlocking member including a free end thereof extending to an intermediate position transversely of axes of the first and second slide spools, and the first and second interlocking positions are selectively provided by connecting the free end to one of the first and second spools through connecting means including engaging pin means and ring-like connector means for fitting on the engaging pin means.

With the above construction, the lever interlocking member is pivotable about the pivotal point located at substantially the same distance to the first and second slide spools. The interlocking member includes a free end thereof extending to an intermediate position transversely of axes of the first and second slide spools. Connecting means is disposed between this free end and the first and second slide spools. The connecting means includes engaging pin means and ring like connector means for fitting on the engaging pin means, one of which is connected to the first and second slide spools and the other connected to the free end of the lever interlocking member. The interlock switching mechanism causes the lever interlocking member to pivot for fitting the ring-like connector means on the engaging pin means. In this interlocked state, the control lever is operatively connected to the slide spool of one of the control valves through the lever interlocking member and the connecting means. The control valve is operated when the control lever is rocked in this state. The state in which the control lever is operatively connected to the first control valve is called a first interlocking position herein, and the state in which the control lever is operatively connected to the second control valve a second interlocking state.

This construction effects transmission of an operating force from the control lever to the slide spools through a mechanism composed of a minimum number of parts, and by pushing and pulling a member extending substantially linearly to the spools. Thus, the movement of the control lever is transmitted to the slide spools with a minimum of play which is provided in a considerable amount through the transmission path of the known structure The interlocking between the control lever and control valves are now established with high response precision.

The connecting means includes the engaging pin means and ring-like connector means contained in a space between the spools. Only a small space is required just for accommodating the connecting means between the spools, hence the object of the present invention noted hereinbefore is achieved with a simple structure requiring a small space.

In a preferred embodiment of the invention, the valve operating structure further comprises a first valve interlocking member connected to the first slide spool and including the first connecting pin, a first clamping member movable with the first valve interlocking member and extending therefrom in a direction intersecting the first slide spool, a first stopper for relatively slidably contacting the first clamping member adjacent a projecting end thereof to prevent the first clamping member from turning relative to a body of the first control valve, a second valve interlocking member connected to the second slide spool and including the second connecting pin, a second clamping member movable with the second valve interlocking member and extending therefrom in a direction intersecting the second slide spool, and a second stopper for relatively slidably contacting the second clamping member adjacent a projecting end thereof to prevent the second clamping member from turning relative to a body of the second control valve.

The first and second stoppers contact and prevent turning of the first clamping member extending from the first valve interlocking member or the second clamping member extending from the second valve interlocking member. Thus, the first or second valve interlocking member, when out of engagement with the lever interlocking member, does not turn to a degree exceeding an angle provided by play present between the clamping member and the stopper.

The turning angle due to the play of the lever interlocking member is made smaller than in the prior art, by providing the clamp members to reduce the distance between the slide spools and stopper acting positions.

In addition to preventing turning of the valve interlocking members by means of the stoppers as noted above, t he clamping members check the turning due to manufacturing or assembling errors and distortions. Consequently, the valve interlocking members do not easily become displaced, thereby to be engageable with the lever interlocking member with ease for a quick and smooth interlock switching operation.

Other features and advantages of the present invention will be apparent from the following description.

BRIEF DESCRIPTION OF THE DRAWINGS

The drawings show control valve operating structures embodying the present invention, in which.

DESCRIPTION OF THE PREFERRED EMBODIMENTS

Embodiments of the present invention will be described hereinafter with reference to the drawings.

Figure 1:
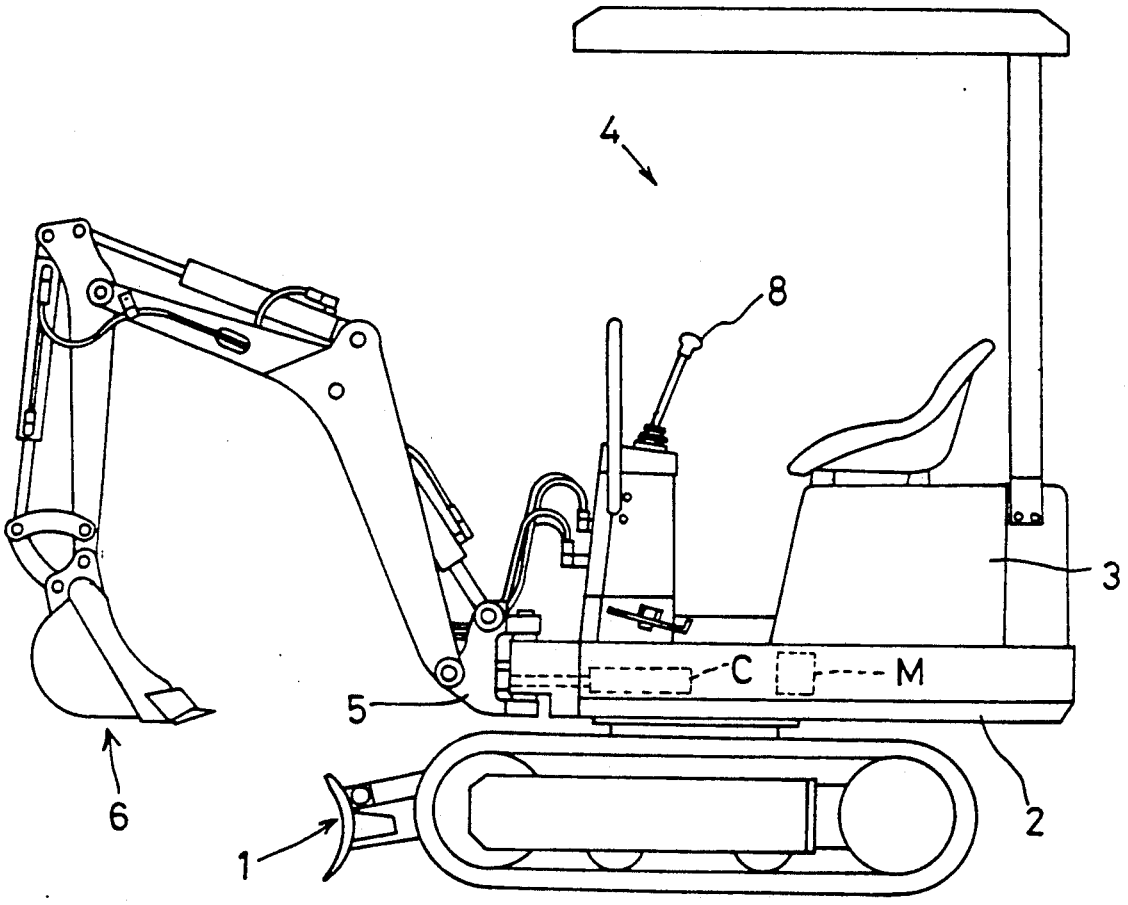
FIG. 1 is a side elevation of a backhoe having a bulldozer blade.

Referring to FIG. 1, a backhoe vehicle comprises a bulldozer blade 1 attached to a track frame having a crawler running device, and a swivel deck 2 mounted on the track frame. The swivel deck 2 carries a motor section 3, a driver's section 4, and a sideways swingable backhoe implement 6 connected through a swing bracket 5.

Figure 2:
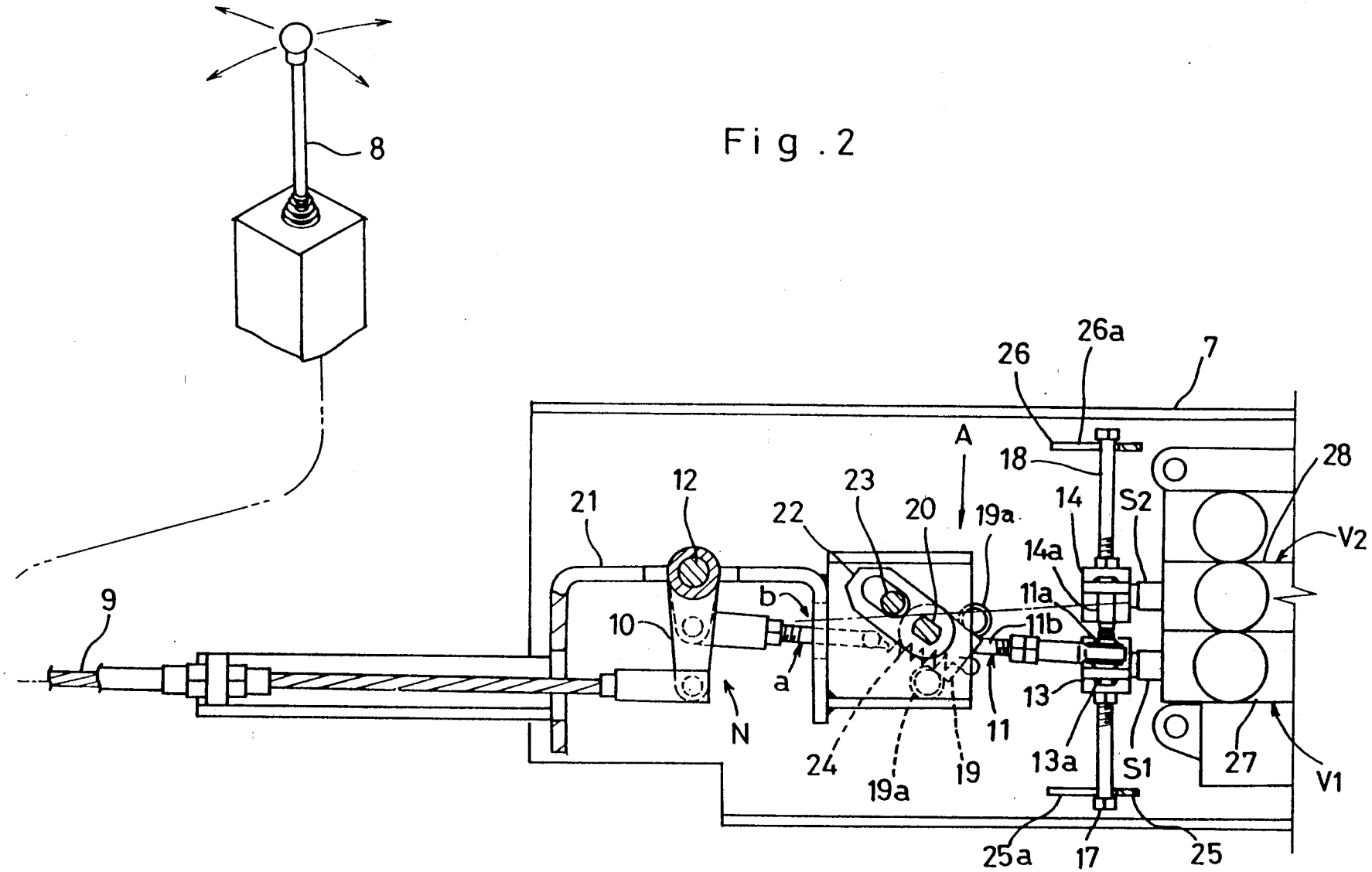
FIG. 2 is a plan view of a control structure for operating a swivel control valve and a swing control valve.

Referring to FIG. 2, a multiple valve structure secured to the swivel deck 2 through a mounting frame 7 includes a swivel control valve V1 connected to a swivel motor M, and a swing control valve V2 connected to a swing cylinder C. The swivel control valve V1 and swing control valve V2 have slide spools S1 and S2, respectively, which extend parallel to each other. A control lever 8 is disposed in the driver's section 4 to be rockable longitudinally and transversely of the swivel deck 2 (FIG. 1). This control lever 8 is longitudinally rockable to switch an arm control valve not shown. The control lever 8 is connected through a wire 9 and a pivotable member 10 acting as a mechanical pivot device N to a lever interlocking member 11. The lever interlocking member 11 is attached to the mounting frame 7 through the pivotable member 10 and its support axis 12. This interlocking member 11 is longitudinally pushed and pulled by the transverse rocking of the control lever 8. The connection between the lever interlocking member 11 and pivotable member 10 provides a pivotal point for the lever interlocking member 11. As seen from FIGS. 3 and 4, a first and a second valve interlocking members 13 and 14 are connected to the slide spools S1 and S1, respectively, each by means of an interlocking pin 15 or 16 and a or tightening bolt 17 or 18 which constitutes clamping members.

Figure 3:
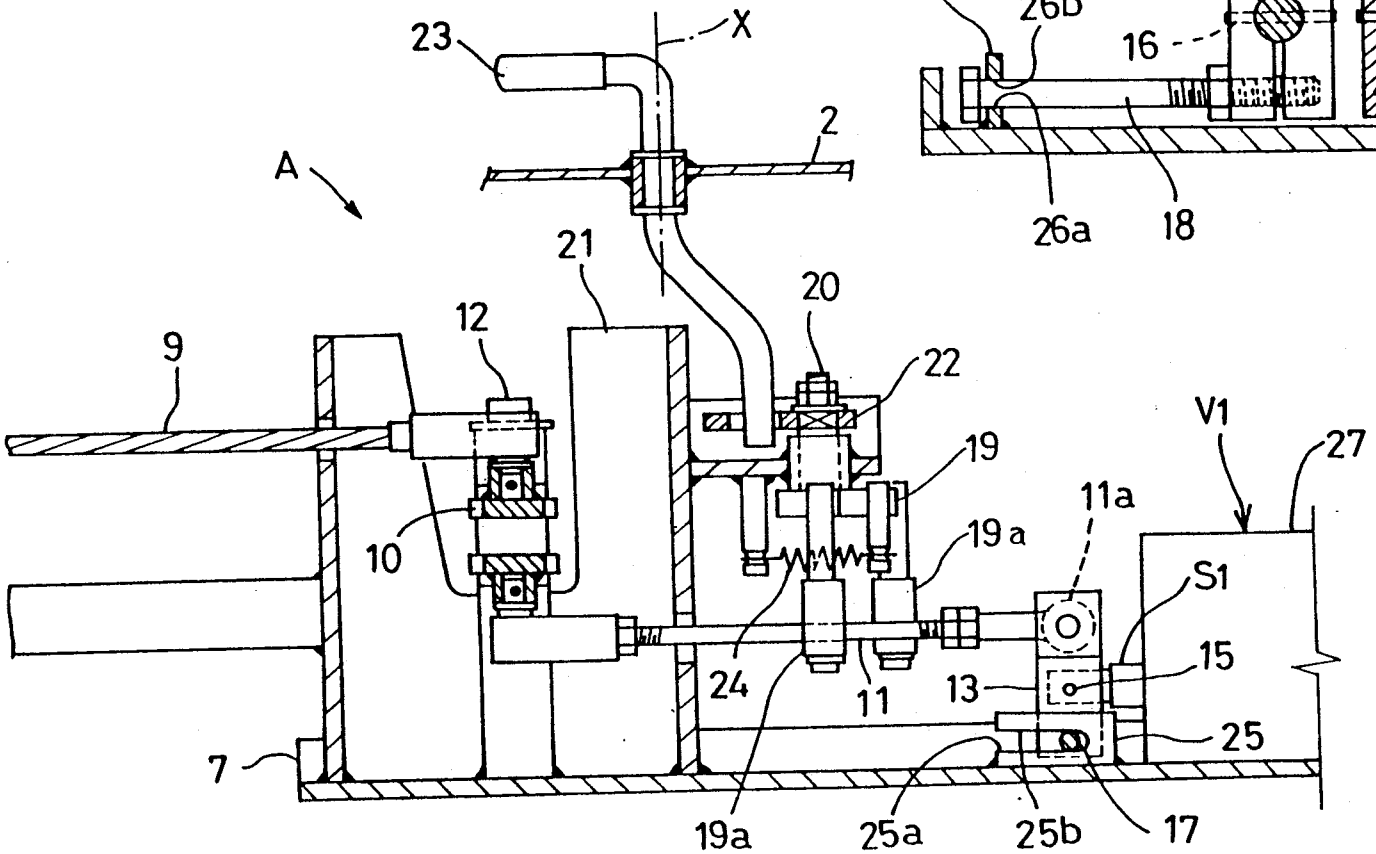
FIG. 3 is a side view, partly broken away, of an interlock switching mechanism.

As shown in FIGS. 2 and 3, the lever interlocking member 11 is also disposed between a pair of pressing rollers 19*a* and 19*a* attached to a control arm 19 which is supported by the mounting frame 7 through a rotatable shaft 20 and a support member 21. The rotatable shaft 20 is connected through a link 22 to a swivel/swing switch lever 23. A toggle spring 24 is provided as an urging member to act on the control arm 19. These components constitute an interlock switching mechanism A, controllable by a manual operation of the switch lever 23, for selectively engaging the lever interlocking member 11 with the first and second valve interlocking members 13 and 14. For expediency, Positions between which the interlock switching mechanism A is changeable are called a first and a second control positions a and b. When the switch lever 23 is turned about an axis X, the switch lever 23 rotates the rotatable shaft 20 through the link 22. Then the control arm 19 pivots about the axis of rotatable shaft 20. One of the pressing rollers 19*a* and 19*a* at this time, presses the lever interlocking member 11 and causes the latter to pivot about a position on the pivotable member 10.

The first and second valve interlocking members 13 and 14 include a first and a second engaging pins 13*a* and 14*a* opposed to each other, respectively. The pivotal axis of the lever interlocking member 11 is located on center lines extending from the first and second engaging pins 13*a* and 14*a*, thus at substantially the same distance to the first and second slide spools S1 and S2. The lever interlocking member 11 includes a linear rod 11*b*, and a ring-like connector 11*a* defining an engaging recess and connected to a free end of the rod 11*b* through a spherical movable element. With the pivotal movement of the lever interlocking member 11, the ring-like connector 11*a* disengages from one of the first and second engaging pins 13*a* or 14*a* and fits on the other pin 13*a* or 14*a*. The ring-like connector 11*a* and engaging pins 13*a* and 14*a* are collectively called a connecting mechanism herein. With the pivotal movement of the control arm 19, the toggle spring 24 is switchable between a position to urge the control arm 19 to a first interlocking position for engaging the lever interlocking member 11 with the first valve interlocking member 13, and a position to urge the control arm 19 to a second interlocking position for engaging the lever interlocking member 11 with the second valve interlocking member 14. Consequently, the lever interlocking member 11 is maintained in engagement with the first or second valve interlocking member 13 or 14 and the switch lever 23 maintained in a corresponding control position.

Thus, the switch lever 23 is operable to control the interlock switching mechanism A for placing the lever interlocking member 11 in engagement with the first or second valve interlocking member 13 or 14, whereby the control lever 8 is operatively connected to the swivel control valve V1 or swing control valve V2. In this state, the control lever 8 is rockable transversely of the swivel deck 2 to switch the swivel control valve V1 for turning or stopping the swivel deck 2, or to switch the swing control valve V2 for swinging the backhoe implement 6.

Figure 4:
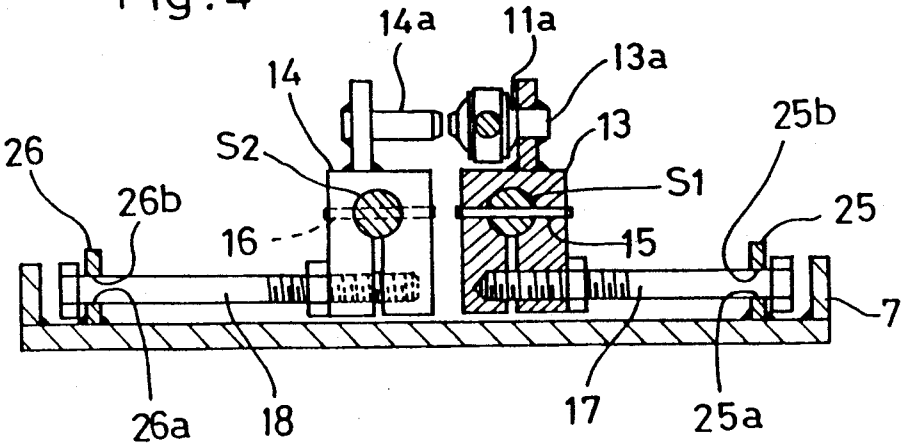
FIG. 4 is a front view, partly broken away, of a portion including stoppers.

Referring to FIGS. 2 and 4, the first and second valve interlocking members 13 and 14 are secured to the slide spools S1 and S2 by the tightening bolts 17 and 18, respectively, which extend from the valve interlocking members 13 and 14 in a direction perpendicular to the slide spools S1 and S2 in plan view. A first and a second stoppers 25 and 26 are fixed to the mounting frame 7 to act on the tightening bolts 17 and 18 adjacent their projecting ends, respectively. As shown in FIG. 3, each stopper 25 or 26 defines a bolt receiving elongate cutout extending in the direction in which the slide spool S1 or S2 is slidable. The cutout allow the tightening bolt 17 or 18 to slide with the slide spool S1 or S2, thereby allowing switching of the swivel control valve V1 and swing control valve V2. Peripheral walls 25*a* and 25*b* or 26*a* and 26*b* of the cutout contact the tightening bolt 17 or 18 and whereby the bolt 17 or 18 prevents the slide spools 51 or 52 from turning with the slide spool S1 or S2 relative to the body 27 or 28 of the swivel control valve V1 or swing control valve V2.

The slide spool S1 or S2 includes a cylindrical portion extending into the body 27 or 20 of the control valve V1 or V2. The valve interlocking member 13 and 14 could therefore turn with vibrations of the vehicle when out of engagement with the lever interlocking member 11. The stopper 25 or 26 effectively checks such turning of the valve interlocking member 25 or 26 through the tightening bolt 17 and 18 in substantial orthodonal relationship with the slide spools. Consequently, the engaging pin 13*a* or 14*a* out of engagement with the lever interlocking member 11 does not easily become displaced from the other engaging pin 13*a* or 14*a* engaging the lever interlocking member 11. This construction facilitates movement of the lever interlocking member 11 from one engaging pin 13*a* or 14*a* to the other for interlock switching.

Figure 5:
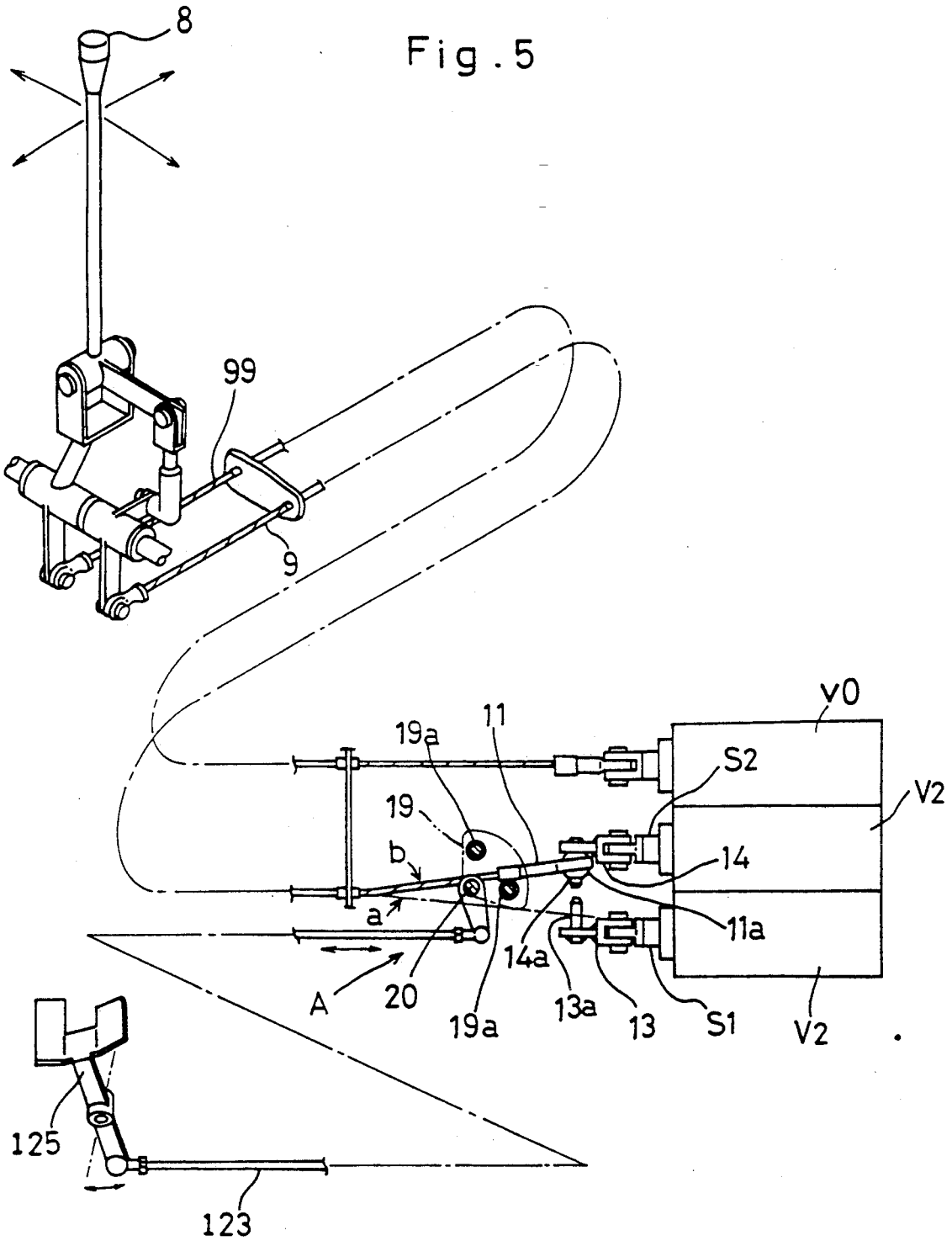
FIG. 5 is a schematic view of a further embodiment.
Figure 6:
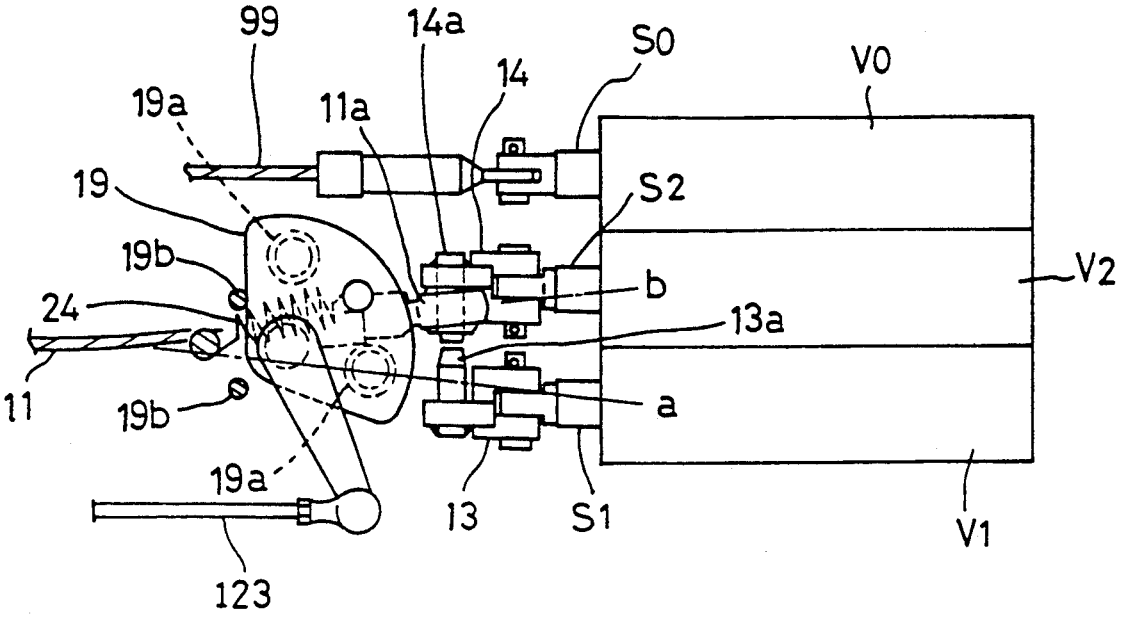
FIG. 6 is a plan view of the further embodiment showing components adjacent control valves.
Figure 7:
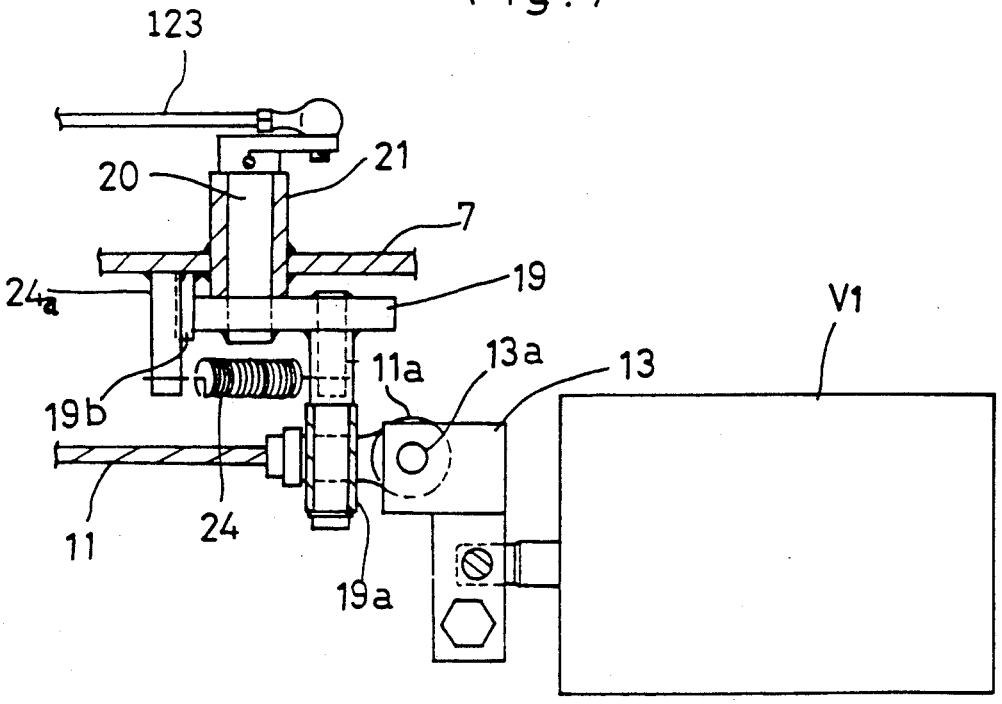
FIG. 7 is a side view, partly broken away, of an interlock switching mechanism in the further embodiment.

A further embodiment will be described with reference to FIGS. 5 through 7.

In this embodiment too, the control lever 8 is rockable longitudinally and transversely of the swivel deck 2 for operating different valves V0, V1 and V2. More particularly, as in the preceding embodiment, the control lever B is transversely rockable to push and pull a first wire 9 for operating the swivel control valve V1 or swing control valve V2, and longitudinally rockable to push and pull a second wire 99 for operating the arm control valve referenced V0. The arm control valve V0 is disposed parallel to and secured to the swivel and swing control valves V1 and V2.

The characterizing feature of this embodiment lies in that the lever interlocking member 11 consists of a rod end having a ring like connector 11*a*, and a part of an inner wire of the first wire 9 connected to the control lever 8. The lever interlocking member 11 is pivotable about an end of an outer wire of the first wire 9. The interlock switching is effected through the pressing rollers 19*a* and 19*a* of the interlock switching mechanism A contacting positions adjacent the rod end. The interlock switching mechanism A is operatively connected through a connecting rod 123 to a switch pedal 125.

This construction provides a highly responsive mechanism with the rocking movement of the control lever transmitted directly to the slide spools engaging pins 13*a* and 14*a* through the first wire 9. Since this transmission is effected to the wire 9, the mechanism is very simple in construction and without limitation as to the transmission path.

The control arm 19 is pivotable within a range defined by a pair of stoppers 19*b* attached to the mounting frame 7. The present invention is applicable for operating various other valves besides the swivel control valve V1 and swing control valve V2, such as a control valve for raising and lowering the bulldozer blade 1 and a control valve for tilting the bulldozer blade 1. Further, the present invention is applicable to various working vehicles besides the backhoe, such as a combine tractor. Therefore, the swivel control valve V1 is also referred to herein as a first control valve, the swing control valve V2 as a second control valve, the slide spool S1 as a first slide spool, and the slide spool S2 as a second slide spool.

Where the stoppers 25 and 26 act on the tightening bolts 17 and 18, respectively, such use of the components for plural purposes contributes toward a simplified construction. However, separate components may be provided specially for the different purposes. Thus, the tightening bolts 17 and 18 are also referred to herein as a first and a second turn stoppers.

What is claimed is:

1. A valve operating structure comprising:

a mounting frame, first and second control valves having first and second slide spools, respectively, which extend parallel to each other, a control lever operatively connected to a lever interlocking member for selectively operating said first and second valves, an interlock switching mechanism for moving said lever interlocking member between a first interlocking position to engage said first slide spool, and a second interlocking position to engage said second slide spool, wherein said lever interlocking member is pivotable about a pivotal point located at substantially the same distance to said first and second slide spools, said lever interlocking member including a linear member extending from said pivotal point and having a free end extending to an intermediate position transversely of a longitudinal axis of said first and second slide spools, and said first and second interlocking positions are selectively provided by connecting said free end to one of said first and second spools through connecting means including engaging pin means connected to one of said first and second slide spools and the free end of said linear member, and ring-like connector means connected to the other of said first and second slide spools and the free end of said linear member, said linear member being oscillatable in three dimensions for fitting said ring-like connector means on said engaging pins means, and stop means for connecting said mounting frame and said connection means preventing the turning of said first and second slide spools about said longitudinal axes of said first and second slide spools of said first and second valves, whereby said stop means positions said pair of engaging pin means in a substantially coplanar arrangement to permit said connecting means to be in alignment when said control lever is in said first interlocking position.

2. A valve operating structure as claimed in claim 1, wherein said engaging pin means includes a first and a second engaging pins connected to said first and second slide spools, respectively, to be coaxially opposed to each other, and said ring-like connector means includes a ring-like connector provided at said free end of said linear member of said lever interlocking member.

3. A valve operating structure as claimed in claim 1, further comprising a wire for transmitting an operating force of said control lever as far as said pivotal point.

4. A valve operating structure as claimed in claim 1, wherein said interlock switching mechanism includes an urging member switchable, with operation of said interlock switching mechanism, between a position to urge said interlock switching mechanism to a first control position corresponding to said first interlocking position, and a position to urge said interlock switching mechanism to a second control position corresponding to said second interlocking position.

5. A valve operating structure as claimed in claim 1, wherein said lever interlocking member includes said linear member being connected to an end thereof to a pivoting mechanism providing said pivotal point.

6. A valve operating structure as claimed in claim 5, wherein said lever interlocking member is formed with a wire connected to said pivoting mechanism and to said control lever.

7. A valve operating structure as claimed in claim 1 wherein said stop means includes:

valve interlocking members fixed to said first and second slide spools, clamping members extending from said valve interlocking members in a direction transverse to said slide spools, and stops which permit said clamping members to move in an axial direction of said spools but preventing rotation of said spools.

8. A valve operating structure as claimed in claim 7, further comprising:

a first valve interlocking member connected to said first slide spool and including said first engaging pin, a first clamping member movable with said first valve interlocking member and extending therefrom in a direction transverse to said first slide spool, a first stop for relatively slidably contacting said first clamping member adjacent a projecting end thereof to prevent said first clamping member from turning relative to a body of said first control valve, a second valve interlocking member connected to said second slide spool and including said second engaging pin, a second clamping member movable with said second valve interlocking member and extending therefrom in a direction transverse to said second slide spool, and a second stop for relatively slidably contacting said second clamping member adjacent a projecting end thereof to prevent said second clamping member from turning relative to a body of said second control valve.

* * * * *